US006891464B2

(12) United States Patent
Scott et al.

(10) Patent No.: US 6,891,464 B2
(45) Date of Patent: May 10, 2005

(54) THERMAL SWITCH STRIKER PIN

(75) Inventors: Byron G. Scott, Arlington, WA (US); George D. Davis, Bellevue, WA (US); James A. Connover, Snohomish, WA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/609,931

(22) Filed: Jun. 30, 2003

(65) Prior Publication Data

US 2004/0263311 A1 Dec. 30, 2004

(51) Int. Cl.[7] ..... H01H 37/54; H01H 37/02

(52) U.S. Cl. ..... 337/343; 337/333; 337/380; 337/417

(58) Field of Search ..... 337/36, 52, 53, 337/333, 342, 343, 380, 417; 29/622

(56) References Cited

U.S. PATENT DOCUMENTS

| | | | | | |
|---|---|---|---|---|---|
| 3,091,121 | A | * | 5/1963 | Moorehead | 60/529 |
| 3,585,328 | A | * | 6/1971 | Fiore et al. | 337/320 |
| 3,845,440 | A | * | 10/1974 | Hunter | 337/341 |
| 4,027,385 | A | * | 6/1977 | Deubel | 29/622 |
| 4,201,967 | A | * | 5/1980 | Romerdahl et al. | 337/354 |
| 4,350,967 | A | * | 9/1982 | Doherty, Jr. | 337/343 |
| 4,528,541 | A | * | 7/1985 | Hollweck et al. | 337/354 |
| 4,581,509 | A | * | 4/1986 | Sanford et al. | 200/83 P |
| 4,754,252 | A | * | 6/1988 | Craig, III | 337/380 |
| 4,794,364 | A | * | 12/1988 | Uehara | 337/354 |
| 4,952,901 | A | * | 8/1990 | Chrupcala et al. | 337/372 |
| 5,043,690 | A | * | 8/1991 | Wahls | 337/370 |
| 5,121,095 | A | * | 6/1992 | Ubukata et al. | 337/365 |
| 5,270,799 | A | * | 12/1993 | Rose | 337/354 |
| 5,285,183 | A | * | 2/1994 | Asada | 337/372 |
| 6,078,246 | A | * | 6/2000 | Davis et al. | 337/347 |
| 6,583,710 | B2 | * | 6/2003 | Hayashi et al. | 337/343 |

FOREIGN PATENT DOCUMENTS

| | | | | |
|---|---|---|---|---|
| GB | 2088132 | A | * 6/1982 | H01H/37/54 |

* cited by examiner

*Primary Examiner*—Anatoly Vortman
(74) *Attorney, Agent, or Firm*—Honeywell Int'l Inc.

(57) ABSTRACT

A striker pin in a thermal switch configured as a mechanical link between a bimetallic disk and an armature spring is provided. The striker pin includes a pin of molded ceramic material. The pin has a generally cylindrical shape, a first axial end, and a second axial end. The first axial end is fastenable in fixed relation to an armature spring. A metalizing film is fused to the second axial end. A metallic deposit is fused to the metalizing film such that the metallic deposit substantially covers the second axial end.

11 Claims, 2 Drawing Sheets

THERMAL SWITCH STRIKER PIN

FIELD OF THE INVENTION

This invention relates generally to switching technology and, more specifically, to thermal switches.

BACKGROUND OF THE INVENTION

Thermostatic switches (thermal switches) are engineered for use in high reliability applications such as Space Science Satellites, Defense Satellites, Commercial Satellites, Manned Space Flight Programs and High-Value Terrestrial Applications. Materials constituting thermal switches (referred to hereafter as "switches") are developed and fabricated to have long life (20+ years) and high reliability while operating under extreme conditions even where service of the switch is impracticable such as an application within Space and Launch Vehicles.

The switches are bimetallic snap action type. A bimetallic disk actuates by detecting temperature change above or below its operational set points. The disk is made of two dissimilar metals: a low expansion side and a high expansion side. These metals are repeatedly rolled together and annealed to create a high state of reduction. The materials are then punched into disks from strip, formed, heat treated, and tested to meet specific temperature requirements. The result is a precision temperature switch.

The bimetallic disk does not have electrical contacts mounted on it. An armature spring is parallel to the bimetallic disk and urges a set of electrical contacts together to form closed a switch. A mechanical link between the bimetallic disk and the armature spring conveys the force created by triggering the disk to the armature spring thereby opening the contacts. That mechanical link is called a striker pin. Conventionally, the striker pin is mounted on the armature spring and bears against the triggered disk. Triggering the bimetallic disk causes it to snap from a concave to a convex shape striking the striker pin. The pin presses, in turn, the armature to the open contact position.

Alumina ($Al_2O_3$) is a preferred material for the striker pin. Its high free energy of formation makes alumina chemically stable and refractory, and hence it finds uses in containment of aggressive and high temperature environments. The high hardness of alumina imparts wear and abrasion resistance. The high volume resistivity and dielectric strength make alumina an excellent electrical insulator. These qualities make it a suitable material for the high temperature and numerous cycles. Unfortunately, alumina is an abrasive material. While fastening prevents the striker pin from wearing into the armature spring, the end of the striker pin bearing against the bimetallic disk often wears or cuts into the surface of the disk over repeated duty cycles. Cycling of the switch and the attendant cutting action of the ceramic on the disk at the disk-to-pin interface affect critical dimensions and generate metallic fragments that might interfere with the operation of the switch.

To stem the wear on the bimetallic disk, a metallic coating is deposited at the point where the striker pin bears against the bimetallic disk. The purpose of the coating is to substitute the smooth lubricious surface of a metal such as nickel for the abrasive surface of the alumina ceramic. The current metal caps are very difficult to place accurately. Unfortunately the placement of the caps is not easily reproducible causing variance in the critical length dimension of the resulting pin. Slightly skewed caps vary the overall length. Epoxy resinous adhesives tend to outgas and degrade in the extreme harsh heated environments the thermal switch is design to operate in.

There is an unmet need in the art for a striker pin with an affixed bearing surface to prevent disk-to-pin wear while maintaining the useful properties of alumina.

SUMMARY OF THE INVENTION

The present invention is a striker pin in a thermal switch configured as a mechanical link between a bimetallic disk and an armature spring. The striker pin includes a pin of molded ceramic material. The pin has a generally cylindrical shape, a first axial end, and a second axial end. The first axial end is fastenable in fixed relation to an armature spring. A metalizing film is fused to the second axial end. A metallic deposit is fused to the metallizing film such that the metallic deposit substantially covers the second axial end.

In accordance with further aspects of the invention, the metallic deposit with its attendant lubricity greatly reduces the wear of the bimetallic disk over that caused by the bare alumina pin.

In accordance with other aspects of the invention, plating the metallic deposit onto the pin is a highly reproducible process providing pins of uniform dimension and wear characteristics.

As will be readily appreciated from the foregoing summary, the invention provides a rugged, smooth, lubricious surface for a pin bearing on a bimetallic disk is also uniform and reduced mass.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

By way of overview, a striker pin in a thermal switch configured as a mechanical link between a bimetallic disk and an armature spring is provided. The striker pin includes a pin of molded ceramic material. The pin has a generally cylindrical shape, a first axial end, and a second axial end. The first axial end is fastenable in fixed relation to an armature spring. A metalizing film is fused to the second axial end. A metallic deposit is fused to the metallizing film such that the metallic deposit substantially covers the second axial end.

The thermal switch is designed for use in high reliability applications such as Space Science Satellites, Defense Satellites, Commercial Satellites, Manned Space Flight Programs and High-Value Terrestrial Applications. Because of the operating environment and the extremely high cost of repair (requiring a separate space flight for replacement) the switches are developed and fabricated to have long life (20+ years) and high reliability while operating under extreme conditions. The switches are bimetallic snap action type relying upon the designed themostatic characteristics of a bimetallic disk.

Figure 1:
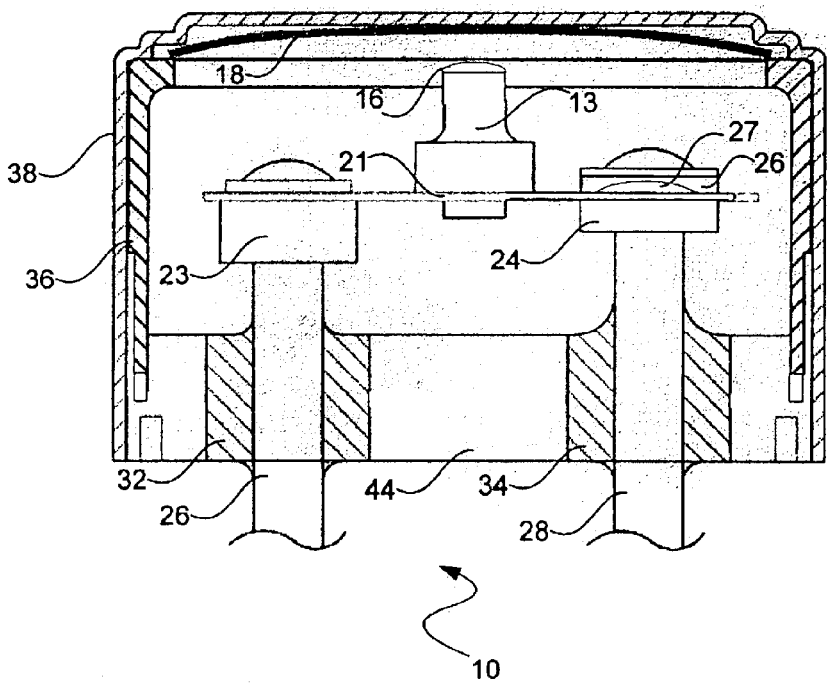
FIG. 1 is a cross-section of a thermal switch showing a striker pin in place and, FIG. 2 is a flowchart of a method to produce the striker pin.

FIG. 1 is a cut-away drawing of the thermal switch 10. A case 38 encloses the components of the switch 10. A bimetallic disk 18 is loosely held inside of a cavity defined by the case 38 and a spacer cylinder 36 coaxially fitted within the case 38. A header plate 44 is perforated suitably to receive an external terminal post 26 and an external terminal post 28, and are placed in fixed relation within the case 38 and spacer cylinder 36 .

A hermetic glass seal 32 holds the external terminal post 26 fixed in one of two perforations to the header plate 44, while a hermetic glass seal 34 holds the external terminal past 28 fixedly in the other perforation. An armature spring is riveted to the top of the terminal post 23. A stationary contact is to the top of the terminal post 24. A striker pin 13 is affixed to the armature spring 21 and bearing against the bimetallic disk 18 during one operating state (contacts open). A metal deposit 16 is affixed at an end of the striker pin 13.

The bimetallic disk 18 actuates by detecting temperature change above or below its operational set points. It actuates by deforming convexly. In doing so the bimetallic disk 18 presses against the striker pin forcing the armature spring 21 to open or to close a pair of electrical contacts (26 and 27) depending upon the designed cycle of the switch 10.

The striker pin 13 includes a ceramic material with a bonded lubricious metal deposit 16, such as nickel or copper Fusion of these dissimilar material is done by a process of metalizing and then plating the surface to achieve good mechanical bonding.

Figure 2:
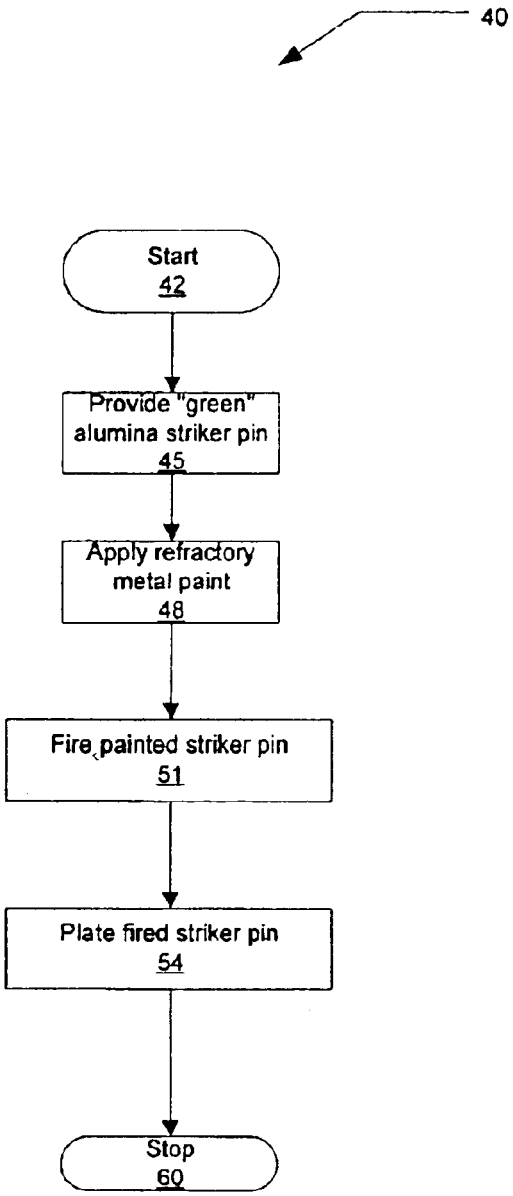

FIG. 2 is a flowchart of a process 40 used to fuse the metal deposit 16 to the striker pin 13. Starting at a terminus block 42, a "green" ceramic pin is provided at a block 45. Green ceramic is an unfired ceramic that has not achieved its vitrification. The green ceramic is solid and machineable and does not have the strength nor the relative smoothness of fired ceramic.

At a block 48, a refractory metal paint, preferable including molybdenum or a similar substance, is applied at the intended site of the metal deposit 16 on the green ceramic pin. The refractory metal paint, in the presently preferred embodiment includes a small amount of manganese (around 10% is generally suitable). The refractive paint is generally applied by either brushing or screen printing onto the ceramic surface to be metalized to form metallic layer.

At a block 51, the ceramic pin with the refractory metal paint is fired (heated). Firing serves two purposes. First, firing cures the ceramic pin bringing it to its vitreous state. Firing also sinters a boundary between the green ceramic and the refractory metal paint causing the metal paint to bond to the ceramic pin. As the ceramic enters the glass phase of firing, the ceramic is drawn into the interstices of the refractory metal paint, i.e., a molybdenum layer of the paint. The added manganese then has two effects. First, upon heating during the sintering, the manganese is oxidized to form manganese oxide, which, at temperature, enhances the permeation of the ceramic in the glass phase into the molybdenum layer. Second, the manganese penetrates down ceramic grain boundaries of the pin and changes the properties of the ceramic in the glass phase. These two changes decrease both the thermal expansion mismatch between the molybdenum layer and the ceramic, and alter the glass transition temperature of the ceramic pin. The results may be enhanced where firing occurs under a greater atmospheric pressure resulting in what is known as "densification," i.e. the further migration of metals in to the boundary region. As a result, there is less residual stress at the metalized interface, which leads to a stronger bond than had previously been achieved with the refractory metals alone.

Once a defect free molybdenum-manganese layer has been successfully applied and fired, the resulting pin is plated with a thin layer of a suitable metal such as nickel or copper. Nickel is preferred for its natural lubricity, but other metals such as copper and metal alloys will work. The immediate plating with nickel prevents oxidation of the Mo—Mn layer. Usually, the nickel is deposited either by electroplating, electroless plating or by the reduction in hydrogen of nickel oxide paint. Upon plating, the pin is suitable for use as the striker pin 13.

Where it is suitable to build the length of the pin for a given application, the metal deposit 16 provides a surface suitable for brazing with conventional braze alloys such as silver at 72% with copper at 28% eutectic, or any of commonly used gold and copper alloys. Sputtering may also be used to deposit the alloy.

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined as follows:

1. A striker pin in a thermal switch configured as a mechanical link between a bimetallic disk and an armature spring, the striker pin comprising:

a pin of molded ceramic material, the pin having a generally cylindrical shape, a first axial end, and a second axial end, the first axial end is fastenable in fixed relation to an armature spring;

a metalizing film fused to the second axial end; and a metallic deposit fused onto the metalizing film such that the metallic deposit is substantially covering the second axial end.

2. The pin of claim 1, wherein the metalizing film includes molybdenum.

3. The pin of claim 2, wherein the metalizing film further includes manganese.

4. The pin of claim 3, wherein the metalizing film further includes manganese oxide.

5. The pin of claim 1, wherein the metallic deposit includes nickel.

6. The pin of claim 1, wherein the metallic deposit includes a nickel alloy.

7. The pin of claim 1, wherein the metallic deposit includes copper.

8. The pin of claim 1, wherein the metallic deposit is includes copper alloy.

9. The pin of claim 1, further including a metallic alloy brazed onto the metallic deposit.

10. The pin of claim 9, wherein the alloy includes approximately 72% silver and 28% copper.

11. The pin of claim 9, wherein the alloy includes gold and copper.

* * * * *